US011569020B2

(12) United States Patent
Kato et al.

(10) Patent No.: US 11,569,020 B2
(45) Date of Patent: Jan. 31, 2023

(54) COIL COMPONENT

(71) Applicant: TDK CORPORATION, Tokyo (JP)

(72) Inventors: Hajime Kato, Tokyo (JP); Satoru Okamoto, Tokyo (JP); Masahiro Kato, Yurihonjo (JP); Makoto Yoshino, Tokyo (JP); Kazuya Tobita, Tokyo (JP); Yuto Shiga, Tokyo (JP); Youichi Kazuta, Tokyo (JP); Noriaki Hamachi, Tokyo (JP)

(73) Assignee: TDK CORPORATION, Tokyo (JP)

( * ) Notice: Subject to any disclaimer, the term of this patent is extended or adjusted under 35 U.S.C. 154(b) by 774 days.

(21) Appl. No.: 16/249,132

(22) Filed: Jan. 16, 2019

(65) Prior Publication Data

US 2019/0237239 A1 Aug. 1, 2019

(30) Foreign Application Priority Data

Jan. 29, 2018 (JP) ..... JP2018-012830

(51) Int. Cl.
*H01F 27/28* (2006.01)
*H01F 27/29* (2006.01)
*H01F 17/00* (2006.01)

(52) U.S. Cl.
CPC ..... *H01F 27/2804* (2013.01); *H01F 17/0013* (2013.01); *H01F 27/29* (2013.01); *H01F 27/292* (2013.01); *H01F 2027/2809* (2013.01)

(58) Field of Classification Search
CPC ..... H01F 27/2804; H01F 2027/2809; H01F 17/0013; H01F 17/0006; H01F 5/003; H01F 27/29; H01F 27/292
USPC ..... 336/200, 232
See application file for complete search history.

(56) References Cited

U.S. PATENT DOCUMENTS 6,452,473 B1 * 9/2002 Suzuki ..... H01F 17/0013 336/200
2006/0006972 A1 * 1/2006 Tozawa ..... H01F 27/292 336/200
2007/0188288 A1 * 8/2007 Ishii ..... H01F 17/0013 336/200
2015/0084481 A1 3/2015 Mori et al.
2015/0318112 A1 * 11/2015 Kwag ..... H01G 4/248 336/200
2015/0371755 A1 * 12/2015 Im ..... H01F 27/2804 336/200
2016/0111194 A1 * 4/2016 Jeong ..... H01F 27/292 336/200
2016/0343501 A1 * 11/2016 Suzuki ..... H01F 27/2828
2017/0018351 A1 * 1/2017 Yatabe ..... H01F 27/2804
(Continued)

FOREIGN PATENT DOCUMENTS

JP 2006-32430 A 2/2006
JP 2006032430 A * 2/2006 ..... H01F 17/0013
(Continued)

*Primary Examiner* — Tszfung J Chan
(74) *Attorney, Agent, or Firm* — Oliff PLC

(57) ABSTRACT

A laminated coil component 1 includes an element body 2, a coil 8 disposed in the element body 2, and a first external electrode 4 and a second external electrode 5, and at least a part of the coil 8 is disposed in a first region A1 and a second region A2 when seen in a facing direction of the pair of side surfaces 2*e* and 2*f*, and the coil 8 is not disposed in a third region A3 and a fourth region A4 when seen in the facing direction of the pair of side surfaces 2*e* and 2*f*.

3 Claims, 8 Drawing Sheets

(56) References Cited

U.S. PATENT DOCUMENTS

| | | | |
|---|---|---|---|
| 2017/0103846 | A1 | 4/2017 | Yoneda |
| 2017/0345552 | A1 | 11/2017 | Nakano et al. |
| 2018/0047484 | A1 | 2/2018 | Mori et al. |

FOREIGN PATENT DOCUMENTS

| | | | | |
|---|---|---|---|---|
| JP | 2015-65284 | A | | 4/2015 |
| JP | 2016-48714 | A | | 4/2016 |
| JP | 2017-005087 | A | | 1/2017 |
| JP | 2017-073536 | A | | 4/2017 |
| JP | 2017073536 | A | * | 4/2017 |
| JP | WO2016/006542 | A1 | | 4/2017 |
| JP | 2017-212372 | A | | 11/2017 |

* cited by examiner

COIL COMPONENT

TECHNICAL FIELD

An aspect of the present invention relates to a coil component.

BACKGROUND

As a conventional coil component, for example, one described in Patent Document 1 (Japanese Unexamined Patent Publication No. 2017-5087) is known. The coil component disclosed in Patent Document 1 includes an element body having a pair of end surfaces facing each other, a pair of main surfaces facing each other, a pair of side surfaces facing each other, a coil disposed in the element body, and a pair of external electrodes disposed on the sides of the pair of end surfaces of the element body. In the coil component described in Patent Document 1, a coil axis of the coil extends in a direction opposite to the pair of side surfaces.

SUMMARY

When the coil component is mounted on a circuit board or the like and bending occurs in the element body, cracks may be generated in the element body. In the coil component, when the bending occurs, stress tends to concentrate on an edge of the external electrode disposed on a mounting surface (one main surface). Therefore, the cracks in the element body may occur toward the end surface starting from the edge of the external electrode. In a configuration in which the coil is electrically connected to the external electrode disposed on the mounting surface, like in the conventional coil component, since the coil is disposed in a region in which the cracks can occur, disconnection may occur in the coil when the cracks are generated in the element body. Accordingly, in the conventional coil component, reliability may decrease.

One aspect of the present invention is to provide a coil component capable of improving reliability.

A coil component according to one aspect of the present invention includes an element body which includes a pair of end surfaces facing each other, a pair of main surfaces facing each other, and a pair of side surfaces facing each other and in which one of the main surfaces is a mounting surface, a coil disposed in the element body, and a first external electrode and a second external electrode disposed on a side of each of the pair of end surfaces of the element body, wherein each of the first external electrode and the second external electrode includes a first portion disposed on the end surface, a second portion disposed on one main surface, and a third portion disposed on the other main surface, a coil axis of the coil extends in a facing direction of the pair of side surfaces, one end of the coil and the first external electrode are electrically connected by a first connecting portion, and the other end of the coil and the second external electrode are electrically connected by a second connecting portion, each of the first connecting portion and the second connecting portion is disposed closer to a side of the other main surface facing the mounting surface than a center of the pair of main surfaces in a facing direction, at least a part of the coil is disposed in a first region partitioned by a first straight line which connects a first contact point between an edge of the second portion of the first external electrode and one main surface to a second contact point between an edge of the third portion and the other main surface, a center line which passes through the center and extends in a facing direction of the pair of end surfaces, one end surface, and the other main surface, and a second region partitioned by a second straight line which connects a third contact point between an edge of the second portion of the second external electrode and one main surface to a fourth contact point between an edge of the third portion and the other main surface, the center line, the other end surface, and the other main surface when seen in the facing direction of the pair of side surfaces, and the coil is not disposed in a third region partitioned by a third straight line which connects the first contact point to a first intersection point between the center line and one end surface, the one end surface, and one main surface, and a fourth region partitioned by a fourth straight line which connects the third contact point to a second intersection point between the center line and the other end surface, the other end surface, and the one main surface when seen in the facing direction of the pair of side surfaces.

In the coil component according to one aspect of the present invention, the coil is not disposed in the third region and the fourth region. The third region and the fourth region are regions in which cracks may occur when cracks are generated in the element body starting from edges of the second portion of the first external electrode and the second external electrode. In the coil component, since the first connecting portion and the second connecting portion are disposed closer to the side of the other main surface facing the mounting surface than the center of the pair of main surfaces in the facing direction, and the coil is not disposed in the third region and the fourth region, it is possible to avoid disconnection of the first connecting portion, the second connecting portion and the coil even when cracks are generated starting from the edges of the second portion of the first external electrode and the second external electrode. Therefore, in the coil component, even when cracks occur in the element body, characteristics are not affected. As a result, in the coil component, reliability can be improved. Also, in the coil component, at least a part of the coil is disposed in the first region and the second region. In this way, in the coil component, a diameter (a length) of the coil can be secured by disposing the coil in a region in which no cracks occur. Therefore, in the coil component, the coil characteristics (Q values) can be improved.

In one embodiment, at least a part of an inner edge of the coil may be disposed in each of the first region and the second region when seen in the facing direction of the pair of side surfaces. In this configuration, since the inner edge of the coil is located in each of the first region and the second region, the diameter of the coil can be further secured. Therefore, in the coil component, the coil characteristics can be improved.

In one embodiment, each of the first external electrode and the second external electrode may have a fourth portion disposed on one side surface, and a fifth portion disposed on the other side surface. With this configuration, it is possible to increase rigidity of the first external electrode and the second external electrode.

In one embodiment, at least a part of the coil may be disposed between the center line and one main surface when seen in the facing direction of the pair of side surfaces. With this configuration, the diameter of the coil can be secured in a configuration in which the coil is not disposed in the third region and the fourth region.

In one embodiment, the coil may not be disposed in a fifth region partitioned by the first straight line, the center line and the third straight line and a sixth region partitioned by the second straight line, the center line and the fourth straight line when seen in the facing direction of the pair of side surfaces. In this configuration, the coil is not disposed in the fifth region and the sixth region in the vicinity of the third region and the fourth region. Therefore, in the coil component, occurrence of the disconnection in the coil can be reliably avoided.

According to one aspect of the present invention, it is possible to improve reliability of the coil component.

DETAILED DESCRIPTION

Figure 1:
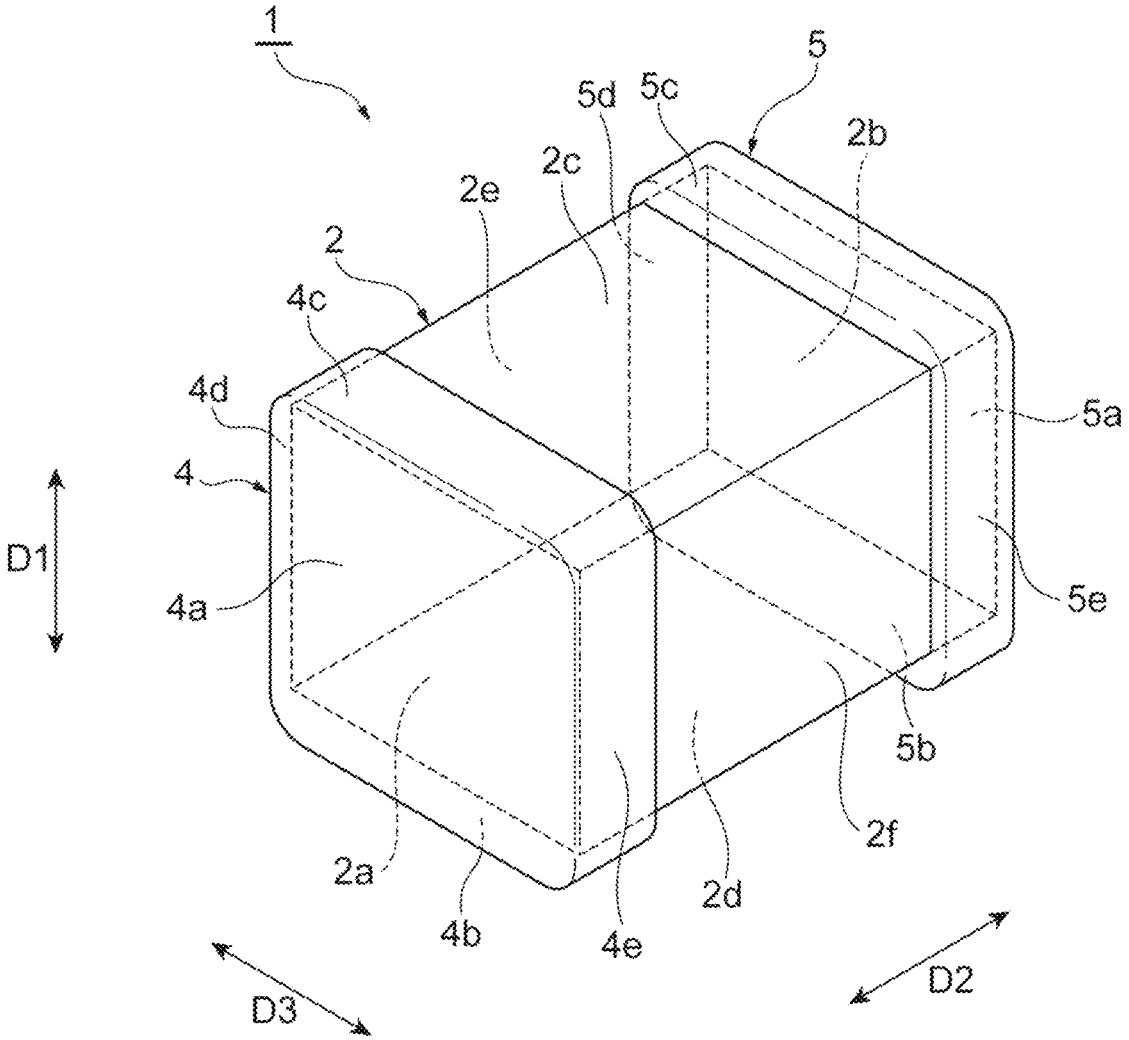
FIG. 1 is a perspective view of a laminated coil component according to one embodiment.

Hereinafter, preferred embodiments of the present invention will be described in detail with reference to the accompanying drawings. In the description of the drawings, the same or corresponding elements are designated by the same reference numerals, and redundant explanations will be omitted.

As shown in FIG. 1, a laminated coil component 1 includes an element body 2, and a first external electrode 4 and a second external electrode 5 disposed at both ends of the element body 2.

The element body 2 has a rectangular parallelepiped shape. The rectangular parallelepiped shape includes a rectangular parallelepiped shape in which corner portions and ridge portions are chamfered, and a rectangular parallelepiped shape in which the corner portions and the ridge portions are rounded. The element body 2 has a pair of end surfaces 2*a* and 2*b* facing each other, a pair of main surfaces 2*c* and 2*d* facing each other, and a pair of side surfaces 2*e* and 2*f* facing each other as outer surfaces. The facing direction in which the pair of main surfaces 2*c* and 2*d* face each other is a first direction D1. The facing direction in which the pair of end surfaces 2*a* and 2*b* face each other is a second direction D2. The facing direction in which the pair of side faces 2*e* and 2*f* face each other is a third direction D3. In the embodiment, the first direction D1 is a height direction of the element body 2. The second direction D2 is a longitudinal direction of the element body 2 and is orthogonal to the first direction D1. The third direction D3 is a width direction of the element body 2 and is orthogonal to the first direction D1 and the second direction D2.

The pair of end surfaces 2*a* and 2*b* extend in the first direction D1 to connect a space between the pair of main surfaces 2*c* and 2*d*. The pair of end surfaces 2*a* and 2*b* also extend in the third direction D3 (a short side direction of the pair of main surfaces 2*c* and 2*d*). The pair of side surfaces 2*e* and 2*f* extend in the first direction D1 to connect a space between the pair of main surfaces 2*c* and 2*d*. The pair of side surfaces 2*e* and 2*f* also extend in the second direction D2 (a long side direction of the pair of end surfaces 2*a* and 2*b*). In the embodiment, the main surface 2*d* is defined as a mounting surface facing another electronic device when the laminated coil component 1 is mounted on another electronic device (for example, a circuit board, an electronic component, or the like).

The element body 2 is configured by stacking a plurality of dielectric layers (insulator layers) 11 in a direction in which the pair of side surfaces 2*e* and 2*f* face each other. In the element body 2, the stacking direction of the plurality of dielectric layers 11 (hereinafter, simply referred to as "stacking direction") coincides with the third direction D3. Each of the dielectric layers 11 is composed of a sintered body of a ceramic green sheet including, for example, a dielectric material (a $BaTiO_3$-based, $Ba(Ti, Zr)O_3$-based, or $(Ba, Ca)TiO_3$-based dielectric ceramic or the like). In the actual element body 2, the dielectric layers 11 are integrated to such an extent that boundaries between the dielectric layers 11 are not visible.

The first external electrode 4 is disposed on the side of the end surface 2*a* of the element body 2, and the second external electrode 5 is disposed on the side of the end surface 2*b* of the element body 2. That is, the first external electrode 4 and the second external electrode 5 are located apart from each other in the facing direction of the pair of end surfaces 2*a* and 2*b*. The first external electrode 4 and the second external electrode 5 contain a conductive material (for example, Ag, Pd or the like). The first external electrode 4 and the second external electrode 5 are composed of a sintered body of a conductive paste containing a conductive metal powder (for example, Ag powder, Pd powder or the like) and a glass frit. Electroplating is applied to the first external electrode 4 and the second external electrode 5 so that a plating layer is formed on surfaces thereof. For example, Ni, Sn or the like is used for the electroplating.

The first external electrode 4 is disposed on the side of one end surface 2*a*. The first external electrode 4 includes five electrode portions including a first electrode portion (a first portion) 4*a* located on the end surface 2*a*, a second electrode portion (a second portion) 4*b* located on the main surface 2*d*, a third electrode portion (a third portion) 4*c* located on the main surface 2*c*, a fourth electrode portion (a fourth portion) 4*d* located on the side surface 2*e*, and a fifth electrode portion (a fifth portion) 4*e* located on the side surface 2*f*. The first electrode portion 4*a*, the second electrode portion 4*b*, the third electrode portion 4*c*, the fourth electrode portion 4*d*, and the fifth electrode portion 4*e* are connected at ridge portions of the element body 2 and are electrically connected to each other. The first external electrode 4 is formed on five surfaces including one end surface 2*a*, the pair of main surfaces 2*c* and 2*d*, and the pair of side surfaces 2*e* and 2*f*. The electrode portions 4*a*, 4*b*, 4*c*, 4*d* and 4*e* are integrally formed.

The second external electrode 5 is disposed on the side of the other end surface 2*b*. The second external electrode 5 includes five electrode portions including a first electrode portion (a first portion) 5*a* located on the end surface 2*b*, a second electrode portion (a second portion) 5*b* located on the main surface 2*d*, a third electrode portion (a third portion) 5*c* located on the main surface 2*c*, a fourth electrode portion (a fourth portion) 5*d* located on the side surface 2*e*, and a fifth electrode portion (a fifth portion) 5*e* located on the side surface 2*f*. The first electrode portion 5*a*, the second electrode portion 5*b*, the third electrode portion 5*c*, the fourth electrode portion 5*d*, and the fifth electrode portion 5*e* are connected at ridge portions of the element body 2 and are electrically connected to each other. The second external electrode 5 is formed on five surfaces including one end surface 2*b*, the pair of main surfaces 2*c* and 2*d*, and the pair of side surfaces 2*e* and 2*f*. The electrode portions 5*a*, 5*b*, 5*c*, 5*d* and 5*e* are integrally formed.

Figure 2:
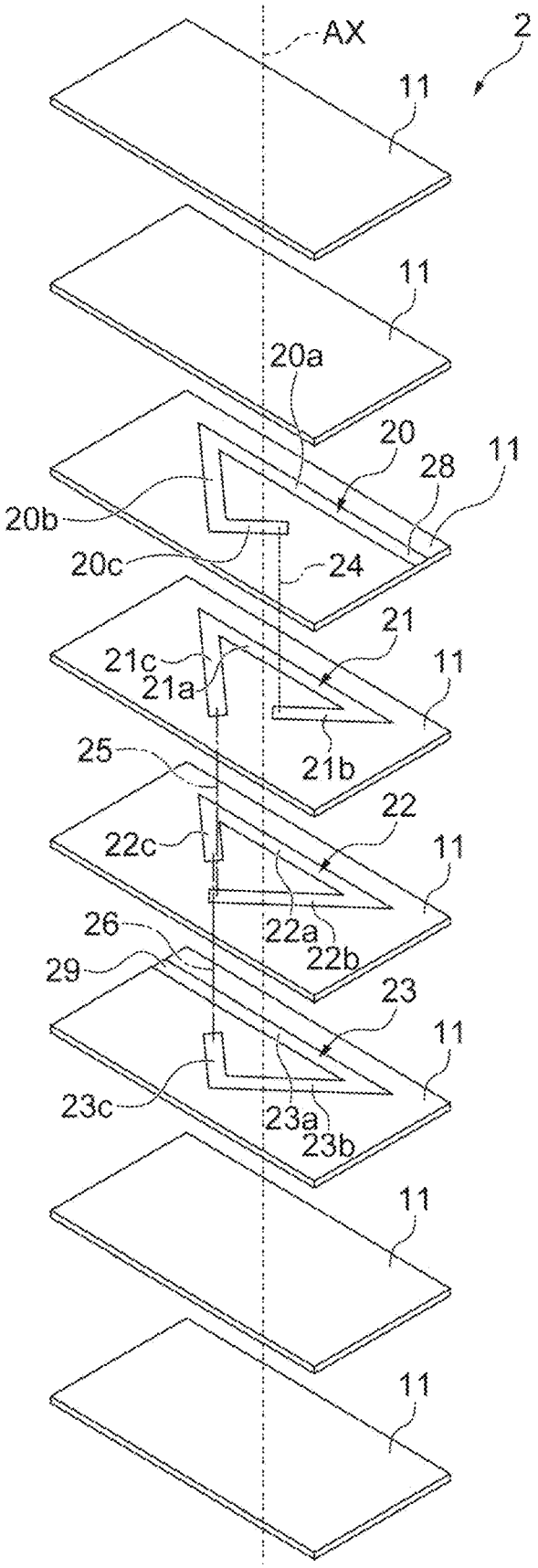
FIG. 2 is an exploded perspective view of an element body in the laminated coil component shown in FIG. 1.
Figure 3:
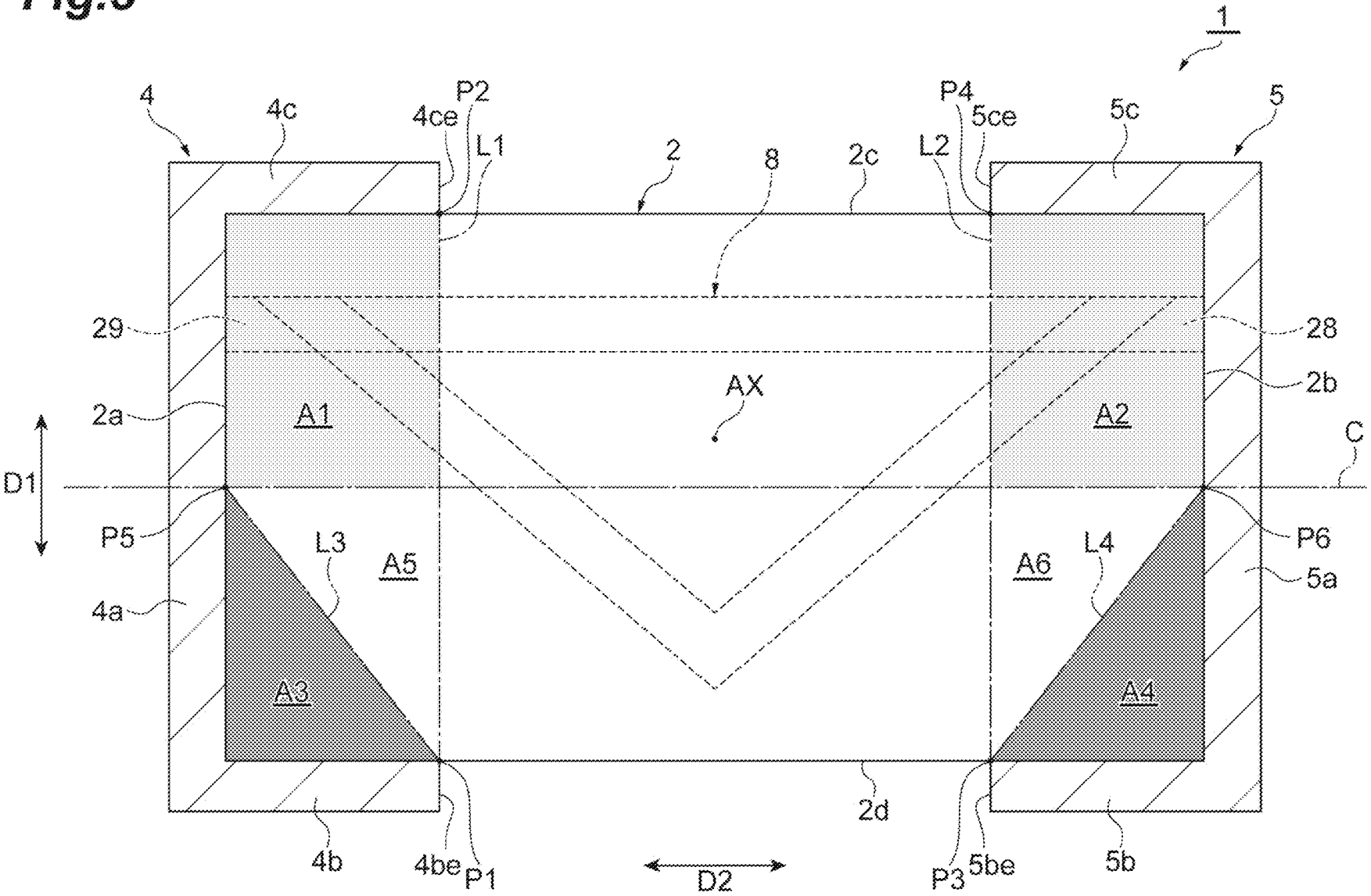
FIG. 3 is a diagram showing a cross-sectional configuration of the laminated coil component.

In the laminated coil component 1, as shown in FIG. 3, a coil 8 is disposed in the element body 2. As shown in FIG. 2, the coil 8 is formed by electrically connecting a first conductor 20, a second conductor 21, a third conductor 22, and a fourth conductor 23. Each of the conductors 20 to 23 is formed of a conductive material usually used as a conductor for a coil (for example, Ni, Cu or the like). Each of the conductors 20 to 23 is composed of a sintered body of a conductive paste containing the above-described conductive material.

The first conductor 20 has a first portion 20*a*, a second portion 20*b*, and a third portion 20*c*. Each of the portions 20*a* to 20*c* has a predetermined width and has a linear shape. The first portion 20*a* constitutes one end of the coil 8. The first portion 20*a* and the second external electrode 5 are electrically connected by a second connecting portion 28. The second connecting portion 28 is formed integrally with the first portion 20*a*. The second connecting portion 28 is exposed on the end surface 2*b* of the element body 2 and is directly connected to the second external electrode 5.

The second conductor 21 has a first portion 21*a*, a second portion 21*b* and a third portion 21*c*. Each of the portions 21*a* to 21*c* has a predetermined width and has a linear shape. The first conductor 20 and the second conductor 21 are electrically connected by a through-hole conductor 24. Specifically, one end of the third portion 20*c* of the first conductor 20 and one end of the second portion 21*b* of the second conductor 21 are connected by the through-hole conductor 24.

The third conductor 22 has a first portion 22*a*, a second portion 22*b* and a third portion 22*c*. Each of the portions 22*a* to 22*c* has a predetermined width and has a linear shape. The second conductor 21 and the third conductor 22 are electrically connected by a through-hole conductor 25. Specifically, one end of the third portion 21*c* of the second conductor 21 and one end of the second portion 22*b* of the third conductor 22 are connected by the through-hole conductor 25.

The fourth conductor 23 has a first portion 23*a*, a second portion 23*b* and a third portion 23*c*. Each of the portions 23*a* to 23*c* has a predetermined width and has a linear shape. The first portion 23*a* constitutes the other end of the coil 8. The first portion 23*a* and the first external electrode 4 are electrically connected by a first connecting portion 29. The first connecting portion 29 is formed integrally with the first portion 23*a*. The first connecting portion 29 is exposed on the end surface 2*a* of the element body 2 and is directly connected to the first external electrode 4. The third conductor 22 and the fourth conductor 23 are electrically connected by a through-hole conductor 26. Specifically, one end of the third portion 22*c* of the third conductor 22 and one end of the third portion 23*c* of the fourth conductor 23 are connected by the through-hole conductor 26.

As shown in FIG. 3, a coil axis AX (a direction of an axial center) of the coil 8 extends in the third direction D3 (the facing direction of the pair of side surfaces 2*e* and 2*f*). The coil axis AX of the coil 8 extends to be parallel to the main surface 2*d* which is the mounting surface of the element body 2. In the embodiment, the coil 8 has a substantially triangular shape when viewed in the third direction D3 (when seen in a direction along the coil axis AX).

In the laminated coil component 1, each of the second connecting portion 28 and the first connecting portion 29 is disposed closer to the side of the main surface 2*c* (the side opposite to the main surface 2*d* which is the mounting surface) than a center (a position of ½) of the element body 2 in the first direction D1 (the height direction of the laminated coil component 1). The second connecting portion 28 is disposed in a second region A2 which will be described later when seen in the third direction D3. The first connecting portion 29 is disposed in a first region A1 which will be described later when seen in the third direction D3.

A region of the element body 2 partitioned by a center line C passing through a center of the first direction D1 and extending in the second direction D2, a first straight line L1 which connects a first contact point P1 between an edge (an end surface) 4*be* of the second electrode portion 4*b* of the first external electrode 4 and the main surface 2*d* to a second contact point P2 between an edge 4*ce* of the third electrode portion 4*c* and the main surface 2*c*, the end surface 2*a* and the main surface 2*c* is defined as a first region A1 when seen in the third direction D3. That is, the first region A1 is a region surrounded by the center line C, the first straight line L1, and the end surface 2*a*, and the main surface 2*c* of the element body 2. The first region A1 has a rectangular shape.

A region of the element body 2 partitioned by the center line C, a second straight line L2 which connects a third contact point P3 between an edge 5*be* of the second electrode portion 5*b* of the second external electrode 5 and the main surface 2*d* to a fourth contact point P4 between an edge 5*ce* of the third electrode portion 5*c* and the main surface 2*c*, the end surface 2*b* and the main surface 2*c* is defined as a second region A2 when seen in the third direction D3. That is, the second region A2 is a region surrounded by the center line C, the second straight line L2, and the end surface 2*b* and the main surface 2*c* of the element body 2. The second region A2 has a rectangular shape.

A region of the element body 2 partitioned by a third straight line L3 which connects a first intersection point P5 between the center line C and the end surface 2*a* to the first contact point P1 between the edge 4*be* of the second electrode portion 4*b* of the first external electrode 4 and the main surface 2*d*, and the end surface 2*a* and the main surface 2*d* is defined as a third region A3 when seen in the third direction D3. That is, the third region A3 is a region surrounded by the third straight line L3, and the end surface 2*a* and the main surface 2*d* of the element body 2. The third region A3 has a triangular shape.

A region of the element body 2 partitioned by a fourth straight line L4 which connects a second intersection point P6 between the center line C and the end surface 2*a* to the fourth contact point P4 between the edge 5*be* of the second electrode portion 5*b* of the second external electrode 5 and the main surface 2*d*, and the end surface 2*b* and the main surface 2*d* is defined as a fourth region A4 when seen in the third direction D3. That is, the fourth region A4 is a region surrounded by the fourth straight line L4, and the end surface 2*b* and the main surface 2*d* of the element body 2. The fourth region A4 has a triangular shape.

A region of the element body 2 partitioned by the first straight line L1, the center line C and the third straight line L3 is defined as a fifth region A5 when seen in the third direction D3. That is, the fifth region A5 is a region surrounded by the first region A1, the third region A3 and the first straight line L1. The fifth region A5 has a triangular shape.

A region of the element body 2 partitioned by the second straight line L2, the center line C and the fourth straight line L4 is defined as a sixth region A6 when seen in the third direction D3. That is, the sixth region A6 is a region surrounded by the second region A2, the fourth region A4 and the second straight line L2. The sixth region A6 has a triangular shape.

When seen in the third direction D3, a part of the coil 8 is disposed in each of the first region A1 and the second region A2. Specifically, parts of an outer edge and an inner edge of a portion of the coil 8 located closer to the side of the main surface 2*c* than the center line C are disposed in each of the first region A1 and the second region A2. In the embodiment, when seen in the third direction D3, a part of the coil 8 is disposed in a region closer to the side of the main surface 2*d* than the center line C3. Specifically, a part including the outer edge and the inner edge of the coil 8 is disposed in the region closer to the side of the main surface 2*d* than the center line C.

When seen in the third direction D3, the coil 8 is not disposed at a position overlapping with the third region A3 and the fourth region A4. That is, when seen in the third direction D3, a conductor constituting the coil 8 is not disposed at the position overlapping with the third region A3 and the fourth region A4. Further, when seen in the third direction D3, the coil 8 is not disposed at a position overlapping with the fifth region A5 and the sixth region A6. That is, when seen in the third direction D3, the conductor constituting the coil 8 is not disposed at the position overlapping with the fifth region A5 and the sixth region A6.

As described above, in the laminated coil component 1 according to the embodiment, the coil is not disposed in the third region A3 and the fourth region A4. The third region A3 and the fourth region A4 are regions in which cracks can occur when cracks are generated in the element body 2 starting from the edge 4*be* of the second electrode portion 4*b* of the first external electrode 4 and/or the edge 5*be* of the second electrode portion 5*b* of the second external electrode 5. In the laminated coil component 1, since the first connecting portion 29 and the second connecting portion 28 are disposed closer to the side of the other main surface 2*c* facing the mounting surface than a center of the pair of main surfaces 2*c* and 2*d* in the facing direction (the first direction D1), and the coil 8 is not disposed in the third region A3 and the fourth region A4, even when cracks are generated starting from the edges of the second electrode portions 4*b* and 5*b* of the first external electrode 4 and the second external electrode 5, it is possible to avoid disconnection of the first connecting portion 29, the second connecting portion 28 and the coil 8. Therefore, in the laminated coil component 1, even when cracks occur in the element body 2, characteristics thereof are not affected. As a result, in the laminated coil component 1, reliability can be improved. Also, in the laminated coil component 1, at least a part of the coil 8 is disposed in the first region A1 and the second region A2. In this way, in the laminated coil component 1, a diameter (a length) of the coil 8 can be secured by disposing the coil 8 in a region in which no crack occurs. Therefore, in the laminated coil component 1, the coil characteristics (Q values) can be improved.

In the laminated coil component 1 according to the embodiment, at least a part of the inner edge of the coil 8 is disposed in the first region A1 and the second region A2 when seen in the third direction D3. In this configuration, since the inner edge of the coil 8 is located in the first region A1 and the second region A2, the diameter of the coil 8 can be further secured. Therefore, in the laminated coil component 1, the coil characteristics can be improved.

In the laminated coil component 1 according to the embodiment, the first external electrode 4 is formed on five surfaces including one end surface 2*a*, the pair of main surfaces 2*c* and 2*d*, and the pair of side surfaces 2*e* and 2*f*. The second external electrode 5 is formed on five surfaces including one end surface 2*b*, the pair of main surfaces 2*c* and 2*d*, and the pair of side surfaces 2*e* and 2*f*. With this configuration, it is possible to increase rigidity of the first external electrode 4 and the second external electrode 5.

In the laminated coil component 1 according to the embodiment, at least a part of the outer edge of the coil 8 is disposed between the center line C and one main surface 2*d* when seen in the third direction D3. With this configuration, the diameter of the coil 8 can be ensured in a configuration in which the coil 8 is not disposed in the third region A3 and the fourth region A4.

In the laminated coil component 1 according to the embodiment, the coil 8 is not disposed in the fifth region A5 partitioned by the first straight line L1, the center line C and the third straight line L3 and the sixth region A6 partitioned by the second straight line L2, the center line C and the fourth straight line L4 when seen in the third direction D3. In this configuration, the coil 8 is not disposed in the fifth region A5 and the sixth region A6 in the vicinity of the third region A3 and the fourth region A4. Therefore, in the laminated coil component 1, occurrence of the disconnection in the coil 8 can be reliably avoided.

Although the embodiments of the present invention have been described above, the present invention is not necessarily limited to the above-described embodiments, and various modifications are possible without departing from the gist thereof.

Figure 4:
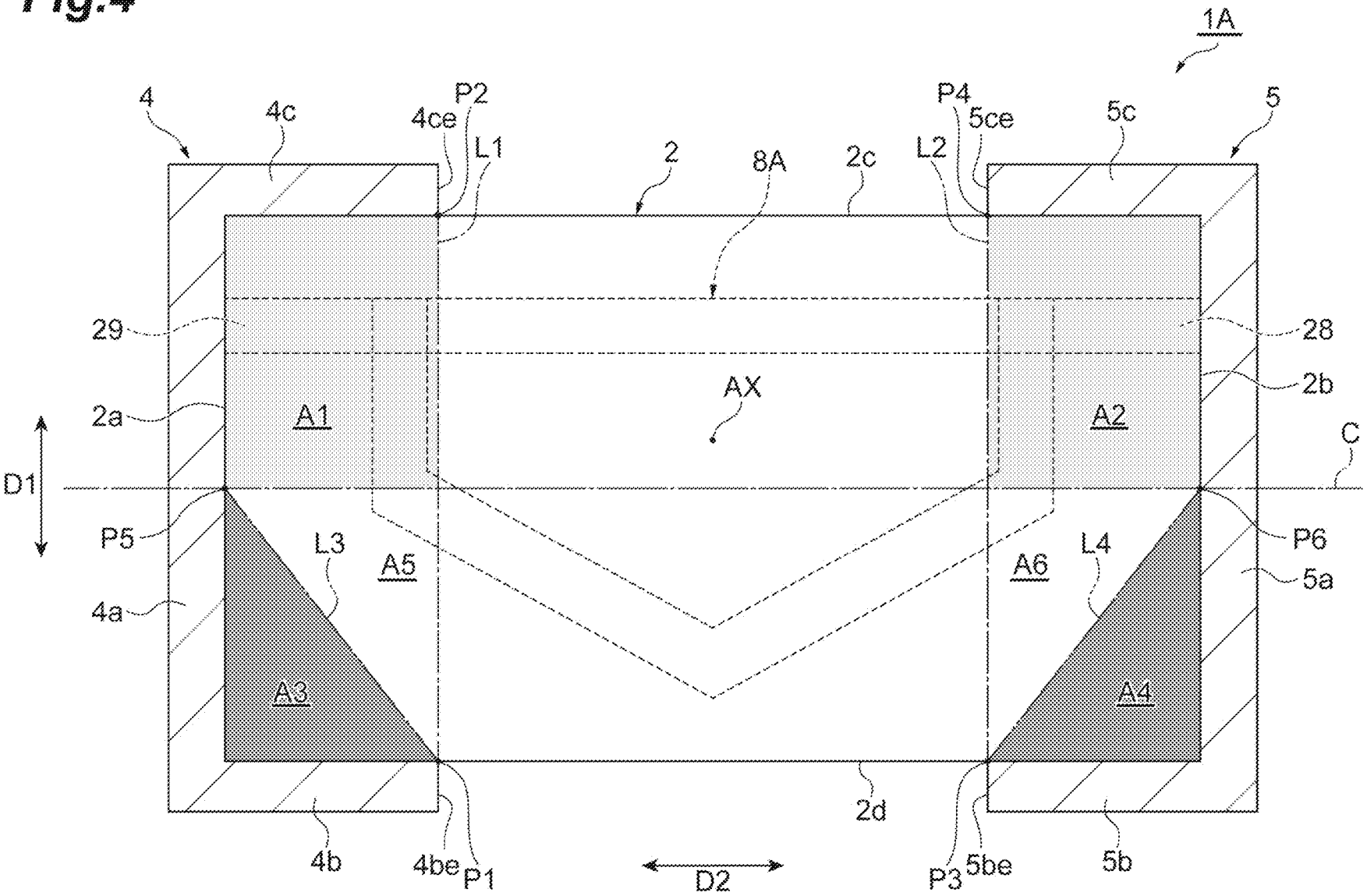
FIG. 4 is a diagram showing a cross-sectional configuration of a laminated coil component according to another embodiment.
Figure 5:
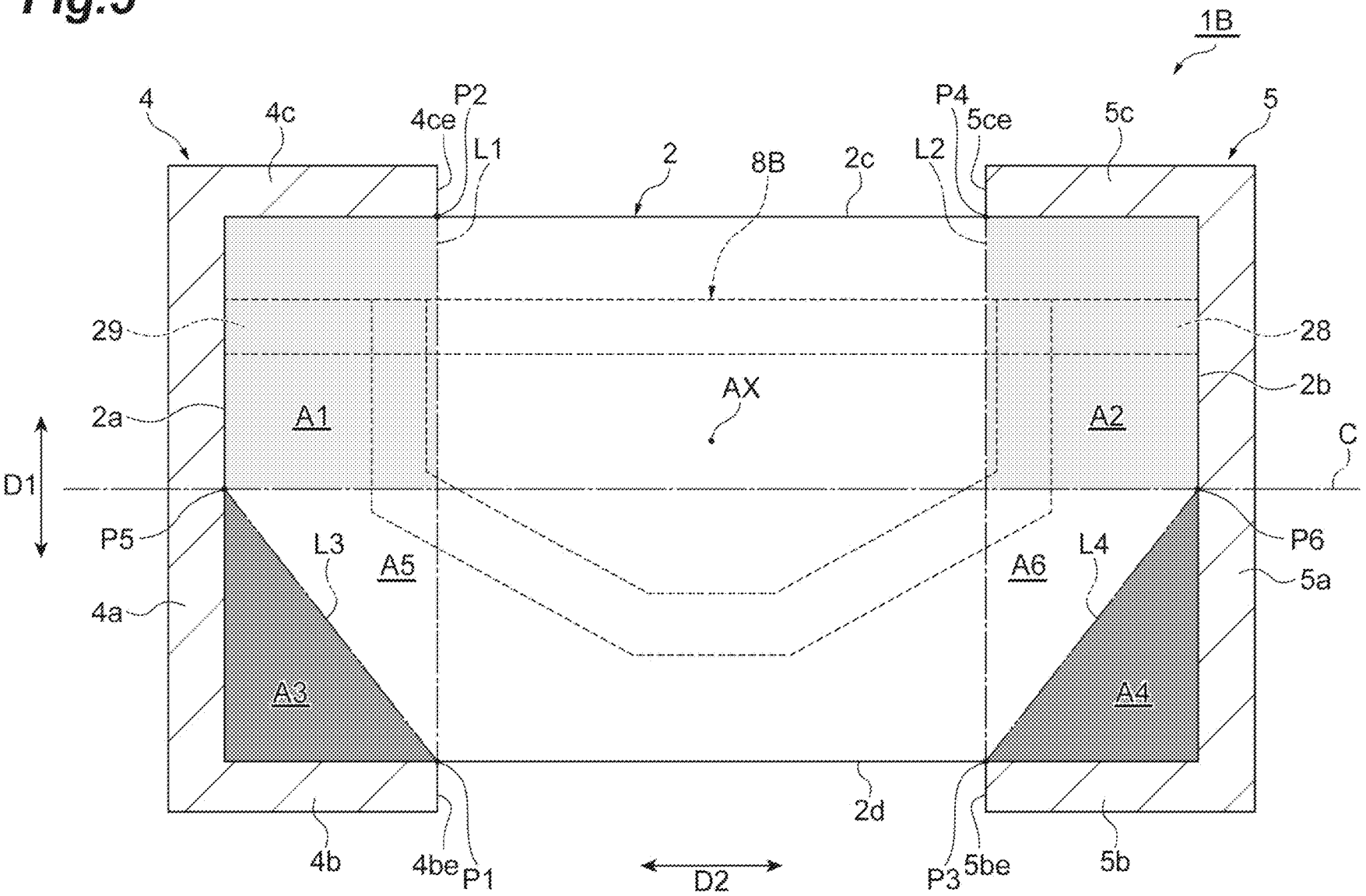
FIG. 5 is a diagram showing a cross-sectional configuration of a laminated coil component according to another embodiment.

In the above-described embodiment, as an example, the coil 8 has a triangular shape when seen in the third direction D3. However, the shape of the coil is not limited to the triangular shape. As shown in FIG. 4, in a laminated coil component 1A, portions of a coil 8A located in the first region A1 and the second region A2 have a linear shape in the first direction D1. As shown in FIG. 5, in the laminated coil component 1B, portions of a coil 8B located in the first region A1 and the second region A2 have a linear shape in the first direction D1, and a top portion located closer to the side of the main surface 2*d* than the center line C has a linear shape in the second direction D2.

Figure 6:
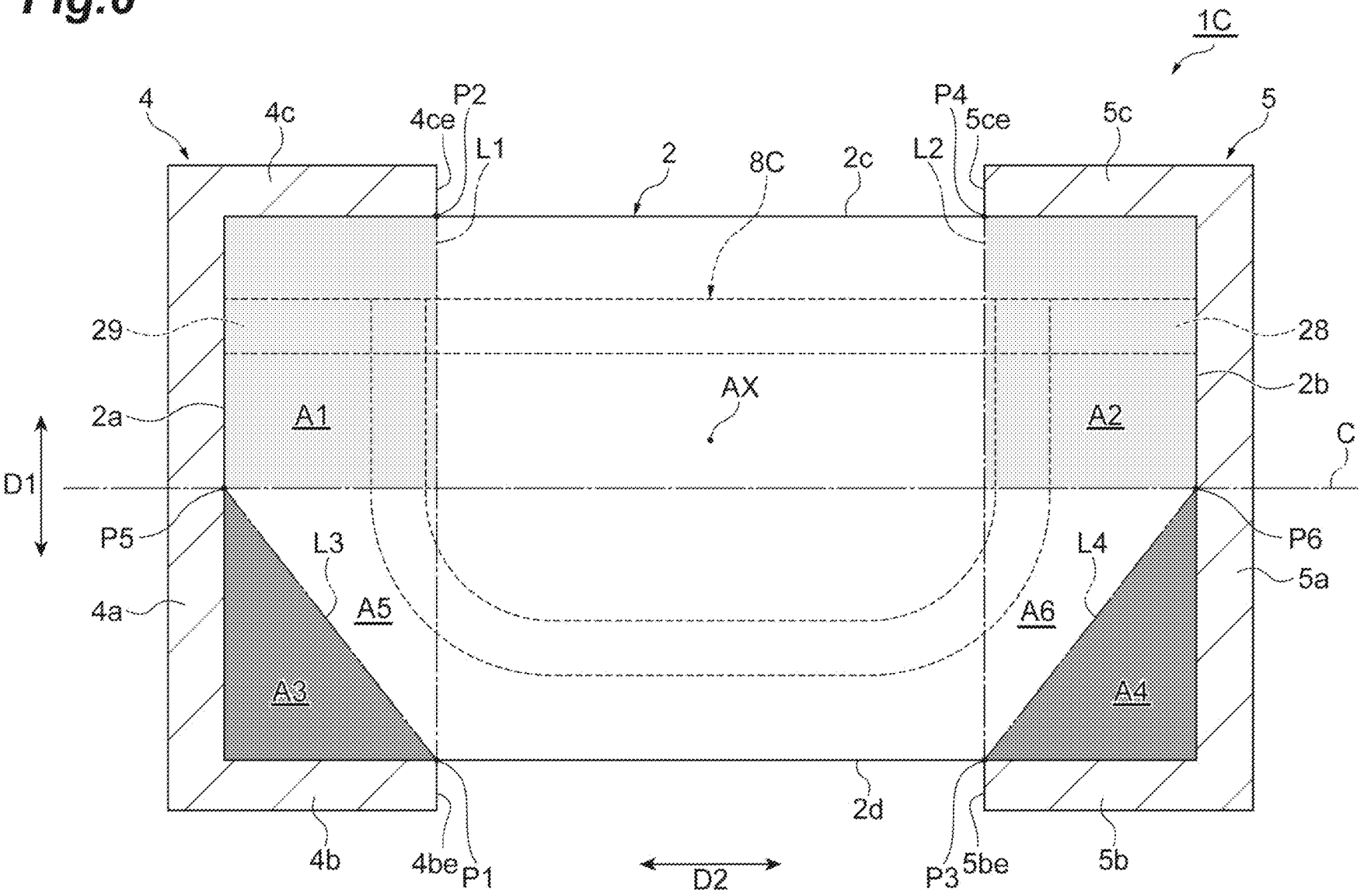
FIG. 6 is a diagram showing a cross-sectional configuration of a laminated coil component according to another embodiment.
Figure 7:
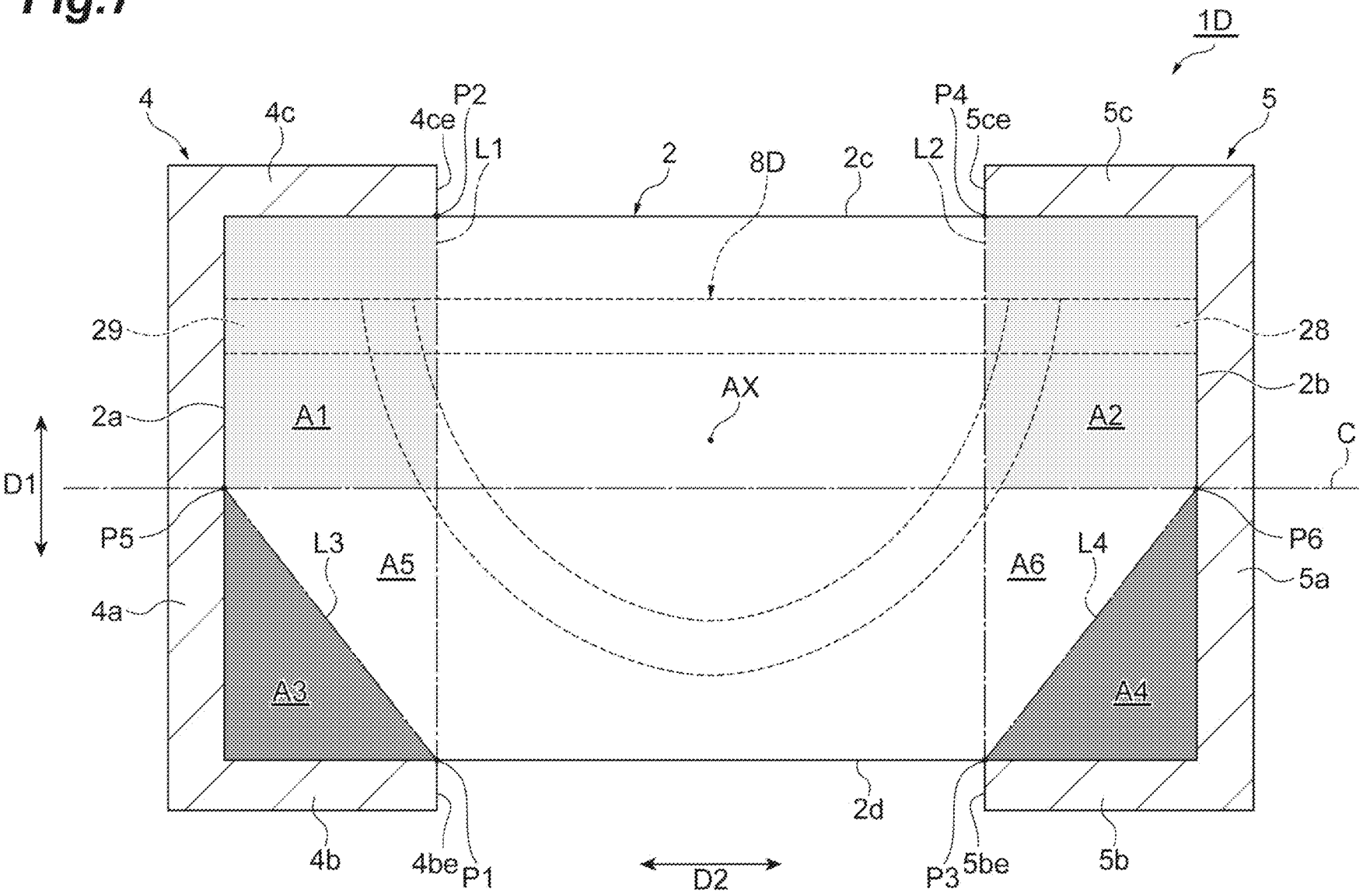
FIG. 7 is a diagram showing a cross-sectional configuration of a laminated coil component according to another embodiment.
Figure 8:
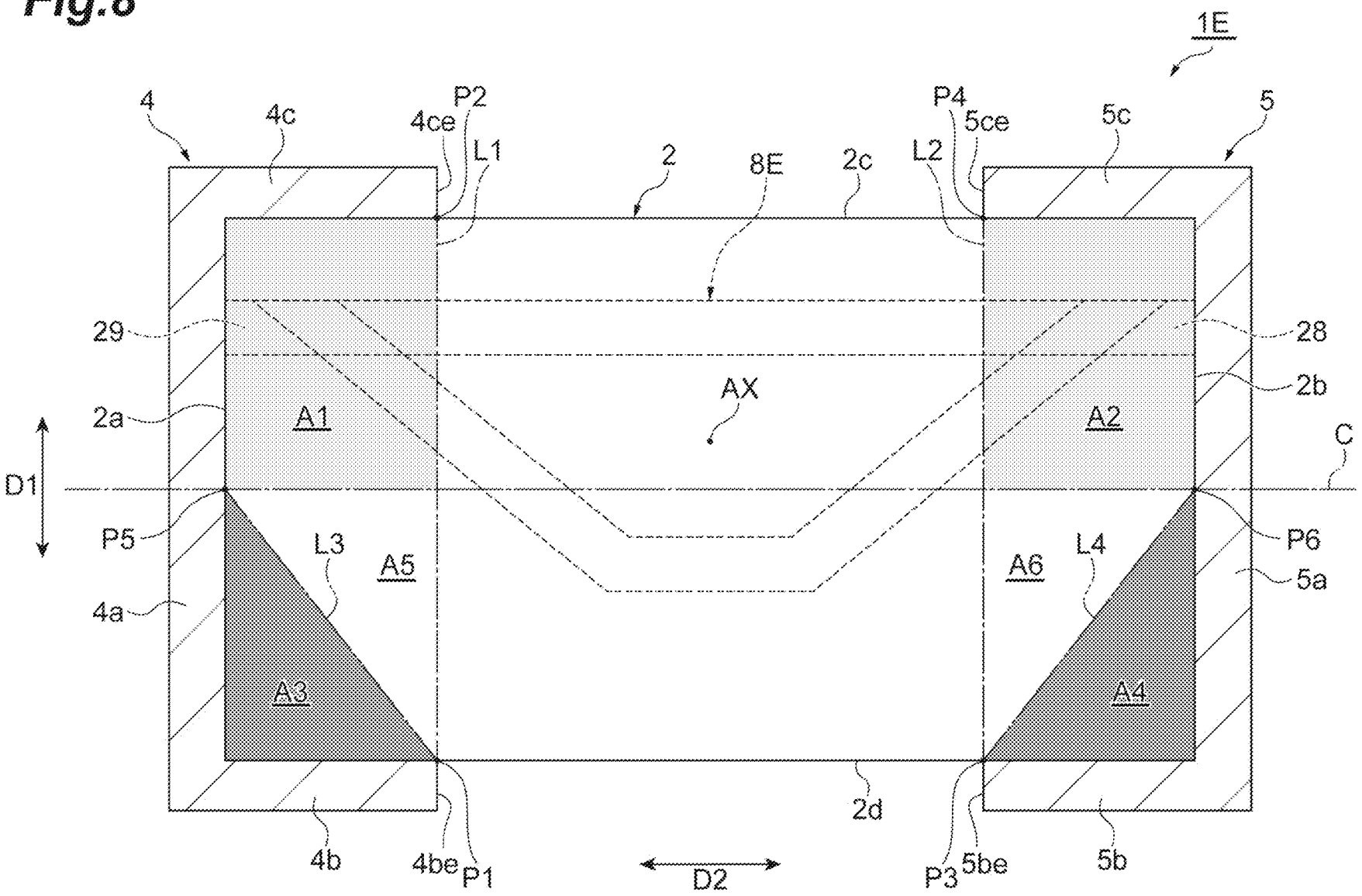
FIG. 8 is a diagram showing a cross-sectional configuration of a laminated coil component according to another embodiment.

As shown in FIG. 6, in a laminated coil component 1C, a coil 8C has a semicylindrical shape. As shown in FIG. 7, in a laminated coil component 1D, a coil 8D has a semicircular shape. As shown in FIG. 8, in a laminated coil component 1E, a coil 8E has a trapezoidal shape.

In the above-described embodiment, the coil 8 is composed of four conductors including the first conductor 20, the second conductor 21, the third conductor 22, and the fourth conductor 23 as an example. However, the number of conductors constituting the coil 8 is not limited to four and may be set as appropriate.

In the above-described embodiment, a type in which the first external electrode 4 has the five electrode portions 4*a*, 4*b*, 4*c*, 4*d* and 4*e* and the second external electrode 5 has the five electrode portions 5*a*, 5*b*, 5*c*, 5*d* and 5*e* has been described as an example. However, the first external electrode 4 may have at least the electrode portions 4*a*, 4*b* and 4*c*, and the second external electrode 5 may have at least the electrode portions 5*a*, 5*b* and 5*c*.

In the above-described embodiment, a type in which a part of each of the coils 8, 8A to 8E is disposed closer to the side of the main surface 2*d* than the center line C when seen in the third direction D3 has described as an example. However, when seen in the third direction D3, the coil may not be disposed closer to side of the main surface 2*d* than the center line C. That is, the coil may be disposed closer to only the side of the main surface 2*c* than the center line when seen in the third direction D3.

What is claimed is:

1. A coil component comprising:

an element body which includes a pair of end surfaces facing each other, a pair of main surfaces facing each other, and a pair of side surfaces facing each other and in which one of the main surfaces is a mounting surface, a coil disposed in the element body, and a first external electrode and a second external electrode disposed on a side of each of the pair of end surfaces of the element body, wherein each of the first external electrode and the second external electrode includes a first portion disposed on the end surface, a second portion disposed on one main surface, a third portion disposed on the other main surface, a fourth portion disposed on one side surface, and a fifth portion disposed on the other side surface, a coil axis of the coil extends in a facing direction of the pair of side surfaces, one end of the coil and the first external electrode are electrically connected by a first connecting portion, and the other end of the coil and the second external electrode are electrically connected by a second connecting portion, each of the first connecting portion and the second connecting portion is disposed closer to a side of the other main surface facing the mounting surface than a center of the pair of main surfaces in a facing direction, the coil is wound in the facing direction of the pair of side surfaces between the first connecting portion and the second connecting portion and is disposed in a first region partitioned by a first straight line which connects a first contact point between an edge of the second portion of the first external electrode and one main surface to a second contact point between an edge of the third portion and the other main surface, a center line which passes through the center and extends in a facing direction of the pair of end surfaces, one end surface, and the other main surface, and a second region partitioned by a second straight line which connects a third contact point between an edge of the second portion of the second external electrode and one main surface to a fourth contact point between an edge of the third portion and the other main surface, the center line, the other end surface, and the other main surface when seen in the facing direction of the pair of side surfaces, the coil is not disposed in a third region partitioned by a third straight line which connects the first contact point to a first intersection point between the center line and one end surface, the one end surface, and one main surface, and a fourth region partitioned by a fourth straight line which connects the third contact point to a second intersection point between the center line and the other end surface, the other end surface, and the one main surface when seen in the facing direction of the pair of side surfaces, the coil has a portion in which distances between an outer edge of the coil and the mounting surface, along the facing direction of the pair of main surfaces, when seen from the facing direction of the pair of side surfaces, increase from the coil axis towards one of the end surfaces in the facing direction of the one of the end surfaces, and the coil has an open interior region, and at least a part of the open interior region is positioned within the first region or the second region when viewed from the facing direction of the pair of side surfaces.

2. The coil component according to claim 1, wherein at least a part of the coil is disposed between the center line and one main surface when seen in the facing direction of the pair of side surfaces.

3. The coil component according to claim 1, wherein the coil is not disposed in a fifth region partitioned by the first straight line, the center line, and the third straight line and a sixth region partitioned by the second straight line, the center line, and the fourth straight line when seen in the facing direction of the pair of side surfaces.

* * * * *